US006939280B2

(12) United States Patent
Iddon

(10) Patent No.: US 6,939,280 B2
(45) Date of Patent: Sep. 6, 2005

(54) DOCUMENT FOLDING APPARATUS

(75) Inventor: Robert Oliver Iddon, Essex (GB)

(73) Assignee: PFE International Limited, Essex (GB)

( * ) Notice: Subject to any disclaimer, the term of this patent is extended or adjusted under 35 U.S.C. 154(b) by 0 days.

(21) Appl. No.: 10/745,405

(22) Filed: Dec. 22, 2003

(65) Prior Publication Data

US 2004/0154487 A1 Aug. 12, 2004

(30) Foreign Application Priority Data

Dec. 20, 2002 (GB) ..... 0229802

(51) Int. Cl.[7] ..... B31B 1/00
(52) U.S. Cl. ..... 493/23; 493/25; 493/231; 493/244
(58) Field of Search ..... 493/3, 8, 23, 25, 493/37, 231, 244, 397, 404, 418, 419

(56) References Cited

U.S. PATENT DOCUMENTS 4,569,672 A * 2/1986 Marion et al. ..... 493/359
4,985,013 A * 1/1991 van der Werff et al. .... 493/444
5,090,671 A * 2/1992 Gombault et al. ..... 270/45
5,425,696 A * 6/1995 Hara et al. ..... 493/414
5,490,829 A 2/1996 Beord et al.
5,769,774 A * 6/1998 Beck et al. ..... 493/421
6,086,522 A * 7/2000 Hechler ..... 493/23
6,663,551 B2 * 12/2003 Auerbach et al. ..... 493/420
6,682,470 B2 * 1/2004 Lin et al. ..... 493/373

FOREIGN PATENT DOCUMENTS

DE 1177857 1/1970
JP 63001676 1/1988

* cited by examiner

*Primary Examiner*—Eugene Kim
(74) *Attorney, Agent, or Firm*—Klarquist Sparkman, LLP

(57) ABSTRACT

A document folding apparatus comprising: a fold plate having one end adjacent a pair of output rollers which have a nip for receiving a document from the fold plate wherein the fold plate, is pivotable about a pivot point spaced from the output rollers and means for moving the fold plate between an aligned and an unaligned position with respect to the nip of the output rollers, wherein the fold plate comprises: an upper and a lower input pinch roller, a pair of guide tracks adjacent the input rollers, and a pair of guide track rollers.

A method of folding a document comprising feeding a document via a fold plate toward a pair of output rollers adjacent to but aligned with an exit of the fold plate; detecting an edge of the document at a point along the fold plate; and at a predetermined time later, pivoting the fold plate so that the exit end passes adjacent the periphery of one of the pair of output rollers causing a section of the document to fold over; and halting the fold place when the end is adjacent the pinch point of the output roller point.

20 Claims, 6 Drawing Sheets

DOCUMENT FOLDING APPARATUS

BACKGROUND

The present invention relates to a document folding apparatus and a method for folding documents.

Printed documents usually need to be folded to fit in an envelope of a convenient size. Documents may typically comprise printed A4 sheets of paper, since this is the size with which modern printers work most efficiently, but may alternatively comprise a typical correspondence size, eg USA letter size.

Typically document sheets are folded once, in a so-called V-fold, or twice in a so-called Z-fold (which sandwiches the middle third of the sheet between the outer two thirds), or a C-fold (in which one of the outer thirds is sandwiched between the other outer third and the middle third). Traditionally this is done using a standard buckle fold apparatus, as shown in FIG. 1. The document to be folded is fed by rollers into a dead-end fold box. The leading edge of the document encounters the end of the box but the trailing edge continues to be driven forward. Consequently the document buckles about a line between the leading and the trailing edge determined by the depth of the box in relation to the length of the document, and the buckling portion is caught in the nip of subsequent rollers to complete the fold and flatten the fold line.

However such known apparatus cannot easily accept documents to which rigid material is attached, for example credit cards or compact discs because they cannot easily negotiate the tight turns inherent in the dead end box folder. Such rigid material is increasingly distributed by mail. For example credit and debit cards are sent attached to forms printed with information identifying the intended recipient and ideally the forms are printed on A4 or letter size paper for printer efficiency and must therefore be folded. Such forms are currently folded using complex expensive equipment which tends to operate at a relatively slow speed and cannot easily be adapted to different fold configurations.

There is a need for a more versatile, speedier and less expensive document folding apparatus.

SUMMARY

According to one aspect of the present invention there is provided a document folding apparatus comprising a fold plate having one end adjacent a pair of output rollers which have a nip for receiving a document from the fold plate, means for pivoting the fold plate about a pivot point spaced from the output rollers, so as to move said one end of the fold plate between an aligned and an unaligned position with respect to the nip of the output rollers.

According to one embodiment of the invention there is provided a document folding apparatus further comprising a second fold plate downstream of the first fold plate, wherein the second fold plate has one end adjacent a second pair of output rollers which have a nip for receiving a document from the second fold plate, means for pivoting the second fold plate about a pivot point spaced from the second pair of output rollers so as to move said one end of the second fold plate between an aligned and an unaligned position with respect to the nip of the output rollers.

According to one embodiment the (or each) fold plate comprises an upper and a lower input pinch roller, a pair of guide tracks adjacent the input rollers, and a pair of guide track rollers.

Means may be provided for controlling the position of the (or each) fold plate in dependence upon the location of a document to be folded, for example, such that the end of the (or each) fold plate is moved into an aligned position when a predetermined length of the document extends beyond the end. This may be measured using a tachometer in the form of a slotted disc attached to one of the rollers so that the speed of the rollers is automatically accounted for. The slot interval should preferably correspond to between about 0.2 mm to 2 mm preferably around 0.5 mm of paper travel giving an acceptable resolution.

A sensor may be provided downstream of the guide track rollers to detect a leading edge of the document to be folded.

According to a second embodiment of the invention there is provided a document folding apparatus wherein the (or each) pivot point is in the region of the lower input roller, preferably at the centre of rotation of the lower input roller.

According to a second aspect of the present invention there is provided a method of folding a document comprising feeding a document along a fold plate generally in the direction, but not aligned with the nip of a pair of output rollers with a predetermined length of the document overhangs an end of the fold plate and pivoting the fold plate so that the end passes by the surface of one of the pair of output rollers causing a section of the document to fold over and halting the fold plate when the end is aligned with the nip of the output rollers.

According to a third aspect of the present invention there is provided a control system for folding apparatus, the control system comprising means for facilitating manual input of a desired fold configuration; means for generating a signal to start movement of the rollers to transport a document along the fold plate; means for generating a signal to pivot the fold plate to a position in which an end of the plate is unaligned with a nip of output rollers; means for sensing the leading edge of the document at a point along the fold plate and for determining when a predetermined length of the document will have passed the end of the fold plate; means for generating a signal to stop the rollers and to pivot the fold plate from the unaligned position toward a position in which the end is aligned with the nip of the output rollers; and means for generating a signal to start the rollers when the fold plate is in the aligned position.

The apparatus and method of the invention is more compact and versatile than a conventional foldbox and could be used for folding fully flexible documents too. The fold lengths need not be equal.

DETAILED DESCRIPTION OF THE FIGURES

Figure 1:
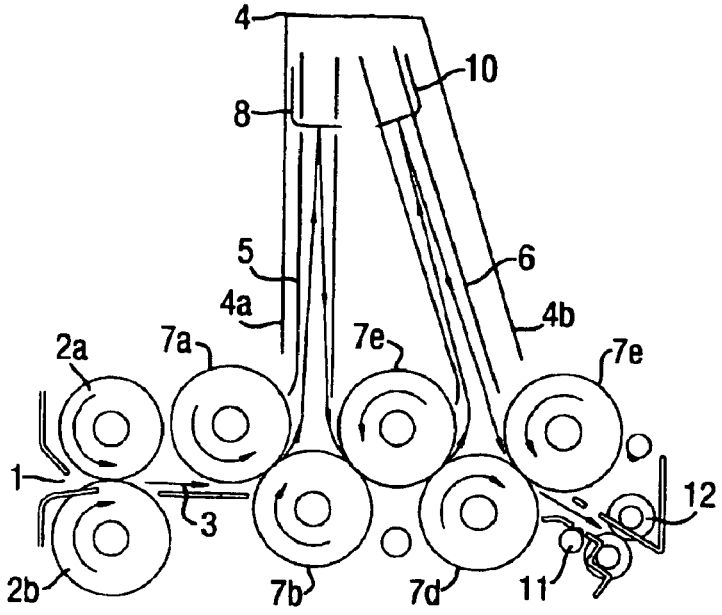
FIG. 1 is a schematic diagram of a prior art document folding apparatus.

FIG. 1 shows a conventional folding machine comprising a foldbox 4 having two sections 4*a* and 4*b*. A document to be folded enters at input opening 1 and is gripped between counter-rotating input feed rollers 2*a* and 2*b* and moved along a feed path 3 in the direction shown by the arrow. The first section 4*a* of the foldbox 4 comprises a first fold plate 5 and the second section 4*b* has a second fold plate 6.

The document to be folded passes between first and second feed rollers 7*a* and 7*b* which drive the document across the first fold plate 5 upwardly to the top of the first section 4*a* of the foldbox 4 where the leading edge of the document hits a first abutment 8. Since the trailing edge is still being driven forward the document buckles along a line between the rollers 7*a*, 7*b* and foldbox 4. This sent or buckled part is caught in the nip of the second 7*b* and a third 7*c* counter-rotating foldbox feed roller and is driven by the third 7*c* and a fourth 7*d* roller into the second section 4*b* of the foldbox 4 which comprises the second fold plate 6 and a second adjustable abutment 10. The second section 4*b* operates in the same way as the first section 4*a* to put a second fold in the document (if desired). Once fully folded by the foldbox 4 the document passes through the nip of the fourth 7*d* and a fifth 7*e* counter-rotating rollers past a hold point sensor pair 11 to a pair of eject rollers 12.

The position of the abutments 8 and 10 is adjustable in the foldbox 4 so as to locate the folds in the document at the required positions.

It will be seen that such a conventional folding apparatus requires the document to pass around tight bends and to negotiate relatively abrupt changes of direction via the fold rollers when it is directed into the fold plates. Such tight angles are generally not practical with rigid cards fixed to the document.

Figure 2A:
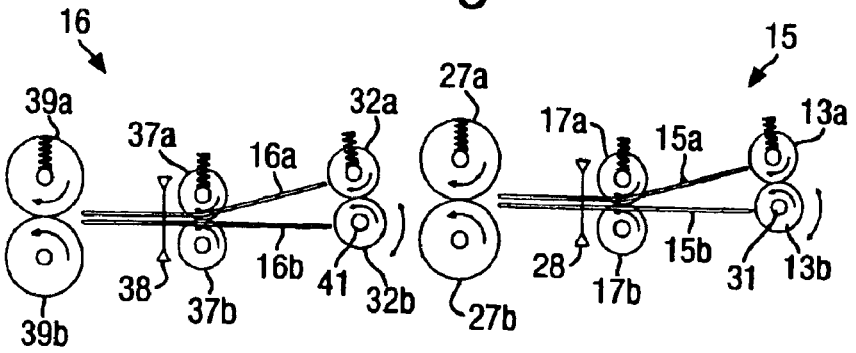
FIG. 2*a* is a schematic cross-sectional diagram of a document folding apparatus according to the present invention.
Figure 2B:
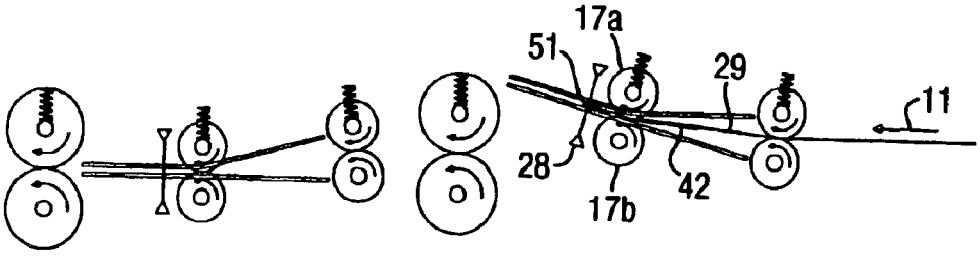
FIGS. 2*b* to 2*g* are schematic diagrams illustrating one example of a folding sequence, using the document folding apparatus of FIG. 2*a*, to produce a V-fold document with address face up.
Figure 2C:
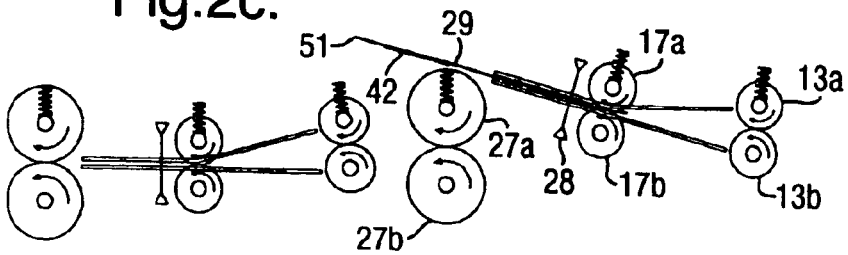
Figure 2D:
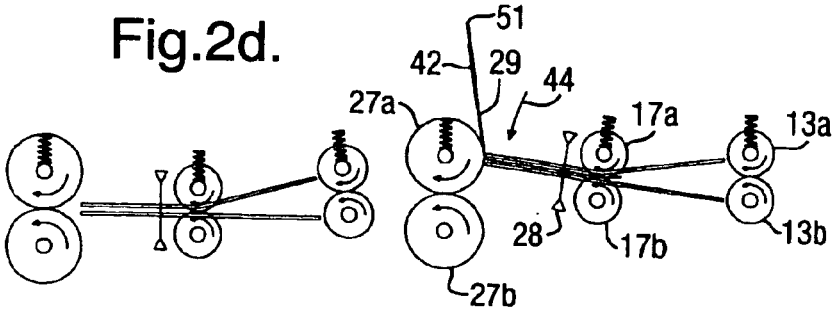
Figure 2E:
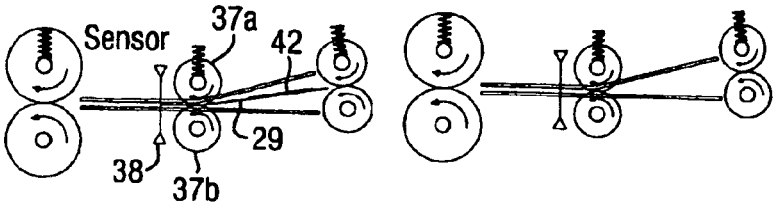
Figure 2F:
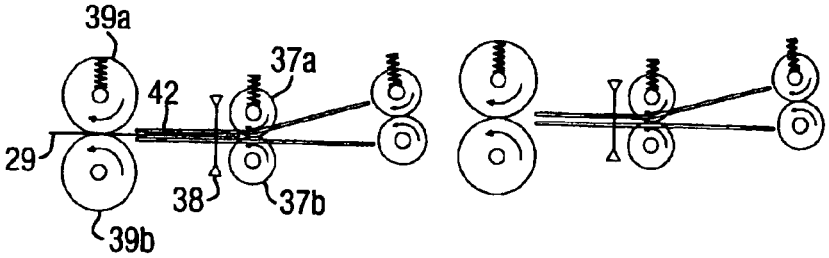
Figure 2G:
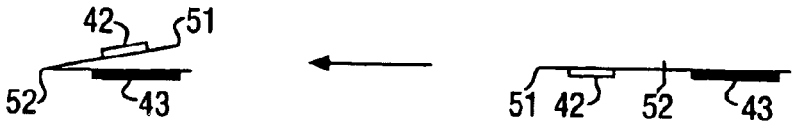

A document folding machine according to the invention is shown in FIGS. 2*a*–2*g* which show a sequence diagram for a first embodiment of the invention, to achieve a V-fold. If a document is fed into this apparatus with a printed address 42 facing downwards and positioned in the leading half of the document, then the finished product is folded in half along line 52 with the address facing upwards as shown in FIG. 2*g*.

A piece of non-flexible material such as a credit card may be positioned anywhere in either half of the document provided it does not straddle the fold line 52. It may be located facing up or down. For example if it faces down in the trailing half of the input document then it will face down on the lower half of the folded document.

In FIG. 2*a* the stationary position of the folding apparatus is shown with a first fold plate 15 on the right hand side, and a second fold plate 16 on the left hand side, as viewed in the figure. The first fold plate 15 comprises a pair of input pinch rollers 13*a* and 13*b*, a pair of converging guide tracks 15*a* and 15*b*, a pair of guide track pinch rollers 17*a* and 17*b*, and a sensor 28 downstream of the guide track rollers 17*a* and 17*b*. At the end of the first fold plate 15 is a pair of output rollers 27*a* and 27*b* to move a document to the second fold plate 16. The first fold plate 15 is pivoted about a pivot point 31 at the centre of rotation 31 of the lower one 13*b* of the input pinch rollers pair.

The second fold plate 16 comprises a pair of second plate input pinch rollers 32*a* and 32*b*, a pair of conveying guide tracks 16*a* and 16*b* and a pair of second guide track pinch rollers 37*a* and 37*b*. A sensor 38 is positioned downstream of the second guide track rollers. At the end of the second fold plate 16 a document exits through exit pinch rollers 39*a* and 39*b*. The second fold plate 16 is pivoted about pivot point 41 on the lower one 32*b* of the pair of second plate input pinch rollers.

A fold sequence is shown in FIGS. 2*b*–2*f*.

A document 29 is presented at the input 11 between the input pinch rollers 13*a* and 13*b*.

A first fold stage is shown in FIG. 2*b*. The guide tracks 15*a* and 15*b*, in the first fold section 15, are pivoted about point 31, into an upper position. The document 29 has an address portion 42 facing down in the leading half and an inflexible attached item 43 such as a credit card facing down in the trailing portion. It is fed through the input rollers 13*a* and 13*b* and through the guide track rollers 17*a* and 17*b*. The leading edge 51 of the document 29 is detected by the sensor 28.

FIG. 2*c* shows the situation at a later period of time with the leading edge 51 and part of the document 29 extending beyond the end of the first fold guide tracks 15*a* and 15*b* with the trailing end of the document 29 still held between the guide track pinch rollers 17*a* and 17*b*.

In FIGS. 2*c* and 2*d* a first fold is made in the document 29 by rotating the first fold plate 15 in an anti-clockwise direction as shown by arrow 44, past the upper one 27*a* of the pair of first stage exit rollers 27*a*, 27*b*, so as to fold the document 29 along fold line 52 between the outer periphery of the upper exit roller 27*a* and the end of the upper guide track 15*a*. The first fold plate 15 continues to be rotated, back to a generally horizontal position as shown in FIG. 2*e*. The document 29 is now folded in half with the address 42 facing up on top and the card 43 on the bottom facing down. This folded document passes through exit pinch rollers 27*a* and 27*b* and enters the second fold plate 16 via the second section input rollers 32*a* and 32*b* and between the second guide tracks 16*a* and 16*b*. Sensor 38 detects the leading edge of the folded document 29 passing through the second fold plate 16 and finally the finished folded document is ejected from the folding apparatus through the second stage exit rollers 39*a* and 39*b*. The finished product is thus folded in half with the address 42 on top and the card 43 below as shown in the left hand side of FIG. 2*g*.

If the document is fed into the apparatus with the credit card and address information 42 facing downward but positioned in the rear half of the document then the finished product will be a V-folded document with the address 42 on the outside facing downward. The card and address may be in the same place on the document but in the case of window envelopes it is usually undesirable to have a card on display for security reasons and in this case the card would be located in a different portion, or on a different side to the address. For documents which are to be inserted in window envelopes it is important for the address information to be on the outside of the folded document and it may be required to be facing upward or downward depending upon the configuration of the envelope inserting apparatus subsequently handling the document.

Figure 3A:
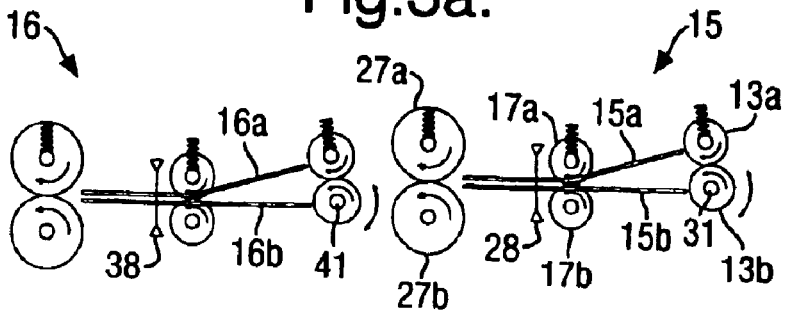
FIGS. 3*a* to 3*i* are schematic diagrams illustrating a second example of a folding sequence, using the document folding apparatus of FIG. 2*a*, to produce a Z-fold document with address face up.
Figure 3B:
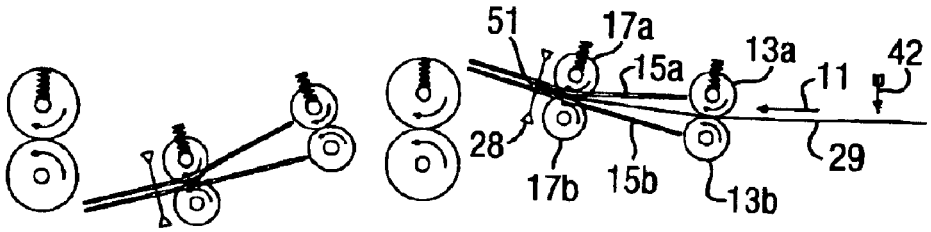

FIGS. 3*a*–3*h* illustrate another embodiment of the invention. Here a document is to be folded in two places in the so-called "Z" fold configuration. FIG. 3*a* shows the stationary position of the apparatus and this is identical to the stationary position for the V-fold, ie to FIG. 2*a*.

Figure 3C:
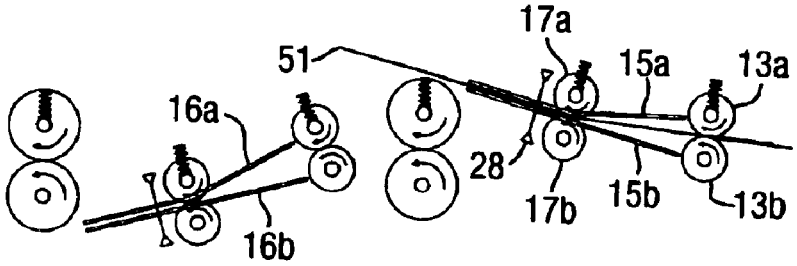
Figure 3D:
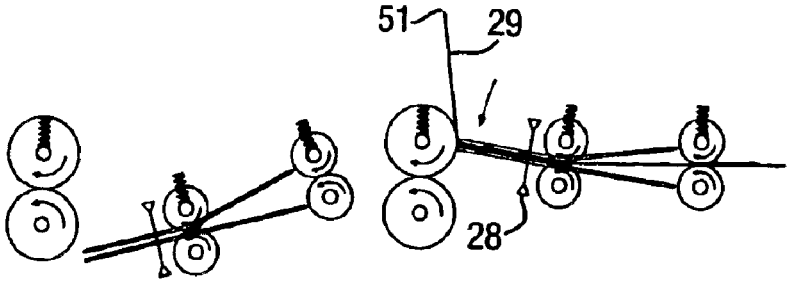
Figure 3E:
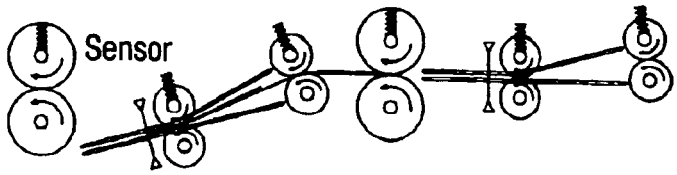
Figure 3F:
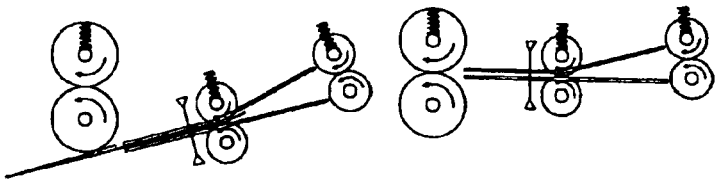
Figure 3G:
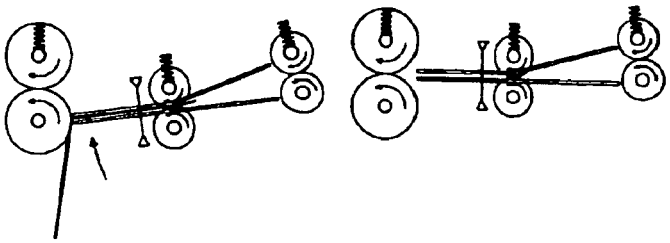
Figure 3H:
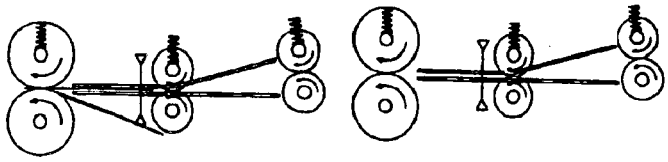
Figure 3I:
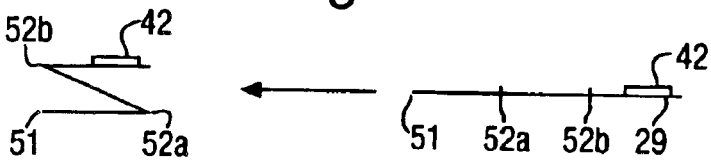

An appropriate input document for this embodiment is shown in the right hand side of FIG. 3*i* with the address 42 on the top in the rear third of the document. A credit card may be positioned in any one of three thirds of the document 29 but not overlying the intended fold lines 52*a* or 52*b* detailing the thirds. The address would usually be at the top of a document and thus could be either the leading or the trailing third.

In order for the address to be on the outside of the folded document for the particular configuration of FIGS. 3*a* to 3*i* the address could be in the trailing section facing upwards, or in the leading section facing downwards, in the input document.

The first stage of the Z-folding process of this embodiment is shown in FIG. 3*c* wherein the first fold plate 15 is rotated about pivot point 31 to an upward position and the second fold plate 16 is rotated about pivot point 41 to a down position. A single document 29 is fed from a paper feed hopper, and has the address 42 located in the trailing segment in the upper facing position. The document 29 engages input pinch rollers 13*a* and 13*b* and is fed between the guide tracks 15*a* and 15*b* to guide track pinch rollers 17*a* and 17*b*. The leading edge 51 is detected by sensor 28. The document 29 is then moved a further pre-determined distance such that approximately one third of the document protrudes from the end of the guide tracks 15*a* and 15*b*, as shown in FIG. 3*c*.

The first fold plate 15 is then rotated as shown in FIG. 3*d* to the mid-position, ie horizontal, corresponding to the stationary position, as shown in FIG. 3*e*. The document 29 creases along the fold line 52*a* at the end of the fold plate 15.

When the fold plate 15 has achieved the mid-position as shown in FIG. 3*e* then the rollers for the first fold plate 15 are re-started to move the newly formed crease 52*a* of the document 29 into the nip of the exit rollers, 27*a* and 27*b*.

In FIG. 3*f* the partially folded document 29 continues to pass into the second fold plate 16. The second sensor 38 detects the new leading edge of the document 29, which in this case is the crease 52*a*, and the rollers are moved so that the document extends approximately a third of its length beyond the leading edge of the second guide tracks 16*a*, 16*b* as shown in FIG. 3*f*. Subsequently the second fold plate 16 is moved as shown in FIG. 3*g* back to its mid-position so as to create the second fold, as shown in FIG. 3*h*. The output form of the document 29 in this particular case will be a Z fold with the address 42 on top as shown in FIG. 3.

Different combinations of movements of the first and second fold plates, combined with variations in the position of the address information on the input document, produce different fold configurations. There are very many different combinations.

For example, if the address information 42 faces downwardly on the trailing end of the document as fed into the apparatus then rotating the first fold plate 15 from a downward to an upward position, and the second fold plate 16 from an upward to a downward position, will produce an output product folded as a "Z" with the address 42 facing downwardly.

For the same input document with the address 42 facing up on the trailing end, if the first fold plate 15 is pivoted from an upward to a downward position and the second fold plate 16 from a downward to an upward position, then the output will be a "Z" fold with the address 42 facing upwardly.

FIGS. 4*a* to 4*i* illustrate a sequence for folding a document in a "C" fold configuration using the apparatus of the invention.

Figure 4A:
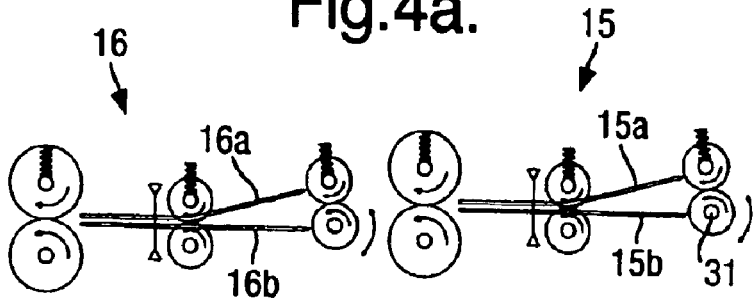
FIGS. 4*a* to 4*i* are schematic diagrams illustrating a third example of a folding sequence, using the document folding apparatus of FIG. 2*a*, to produce a C-fold document with address face down.

FIG. 4*a* illustrates the stationary position of the folding apparatus, and is identical to FIG. 2*a* and FIG. 3*a*.

Figure 4B:
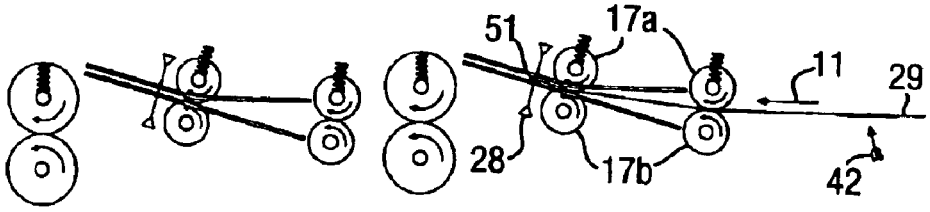
Figure 4C:
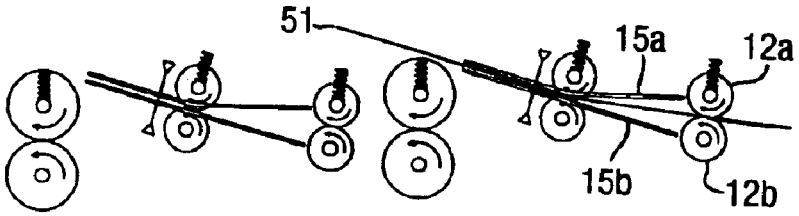
Figure 4D:
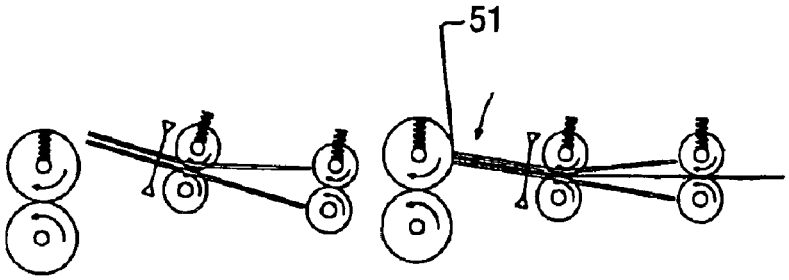
Figure 4E:
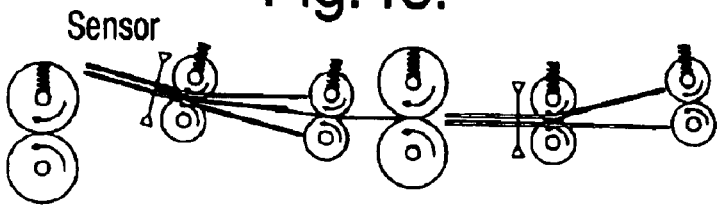
Figure 4F:
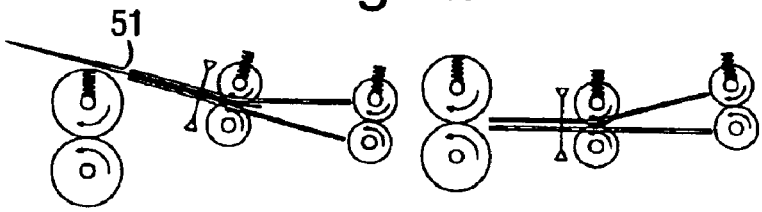
Figure 4G:
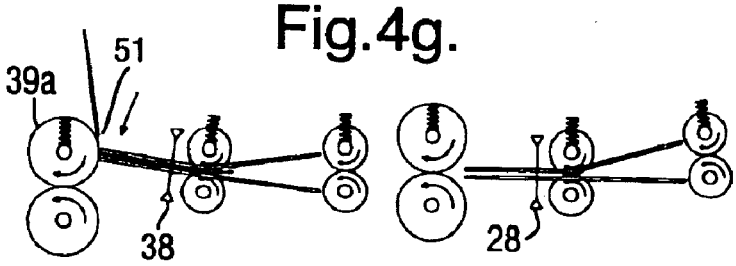
Figure 4H:
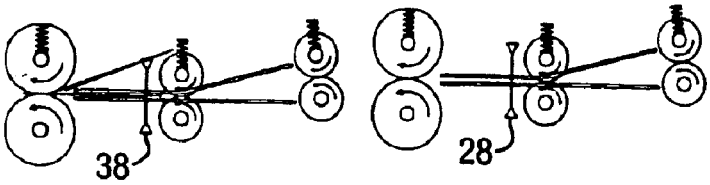
Figure 4I:
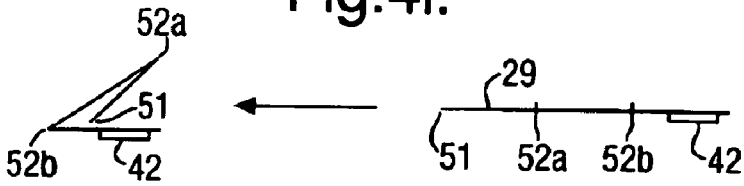

The input document 29 is shown at the right hand side of FIG. 4*i* with address information 42 positioned face down and a card in any one of three segments of the document. The output document is shown on the left hand side of FIG. 4*i* in a "C" fold with the address 42 face down.

This C-fold is achieved by setting both the first fold plate 15 and the second fold plate 16 to start in the up position as shown in FIG. 4*b*.

The document 29 is fed in direction 11 into the first fold plate 15 via input rollers 13*a*, 13*b* and guide rollers 17*a*, 17*b*, past sensor 28, as shown in FIG. 4*c*. The leading edge 51 continues a predetermined distance beyond the sensor 28 such that approximately a third of the document 29 is extended beyond the end of the first fold plate 15, as shown in FIG. 4*c*.

The first fold plate 15 is then rotated to the mid-position, creasing the document, at the one-third line 52*a*, between the end of the first fold plate 15 and the upper first stage exit roller 27*a*. This is shown in FIGS. 4*d* and 4*e*.

The partially folded document 29 then passes out of the first fold plate 15 via exit roller pair 27*a*, 27*b* and into the second fold plate 16 between roller pair 32*a*, 32*b*. It passes between the second stage guide tracks 16*a*, 16*b* and through the track guide rollers 37*a*, 37*b* to sensor 38 as seen in FIG. 4*e*.

The rollers continue to move the document 29 until the partially folded end extends a pre-set distance beyond the end of second fold plate 16 as shown in FIG. 4*f*. The pre-set distance again corresponds to one third of the length of the document 29 in this embodiment.

Subsequently, as illustrated in FIG. 4*g*, the second fold plate 16 is pivoted back down toward the mid-position, creasing the document 29 at the second one third line 52*b*, between the end of the fold plate and the upper exit roller 39*a*.

When the second fold plate 16 is fully returned to the mid-position, as in FIG. 4*h*, then the twice folded document 29 exits the apparatus through the nip of the exit rollers 39*a*, 39*b*. The resulting document is twice folded with one end third tucked between the other two thirds and the address 42 facing down as shown in the left hand side of FIG. 4*i*.

The address 42 will face up if it faces up in the initial document and if both the first fold plate 15 and the second fold plate 16 have the guide tracks pivoted down to start with.

What we claim is:

1. A document folding apparatus comprising:

a fold plate having one end adjacent a pair of output rollers which have a nip for receiving a document from said fold plate, and means for pivoting said fold plate about a pivot point spaced from said output rollers, so as to move said end of said fold plate between an aligned and an unaligned position with respect to said nip of the output rollers, wherein the fold plate comprises an upper and a lower input pinch roller, a pair of guide tracks adjacent the input pinch rollers, and a pair of guide track rollers.

2. A document folding apparatus according to claim 1 further comprising a second fold plate downstream of said first fold plate, wherein said second fold plate has one end adjacent a second pair of output rollers which have a nip for receiving a document from said second fold plate, means for pivoting said second fold plate about a pivot point spaced from said second pair of output rollers, so as to move said end of said second fold plate between an aligned and an unaligned position with respect to said nip of said second pair of output rollers.

3. A document folding apparatus according to claim 1 further comprising means for controlling the position of said one end of said fold plate in dependence upon the location of a document to be folded.

4. A document folding apparatus according to claim 1 wherein said pivot point is in the region of said upper and said lower input pinch roller.

5. A document folding apparatus according to claim 4 wherein said pivot point is located approximately at the centre of rotation of said lower input roller.

6. A document folding apparatus according to claim 1 wherein said unaligned position comprises one of an upper position and a lower position of said end of said fold plate with respect to said pair of output rollers.

7. A document folding apparatus according to claim 1 wherein said fold plate comprises a sensor set to detect the leading edge of a document.

8. A document folding apparatus according to claim 1 further comprising means to automatically pivot said fold plate to said unaligned position before a document reaches said end of said fold plate, and to automatically pivot said fold plate to said aligned position after a predetermined length of the document has passed said end of said fold plate.

9. A document folding apparatus according to claim 8 wherein said predetermined length is determined by an intended fold configuration for the document.

10. A document folding apparatus according to claim 9 further comprising means for manually setting said fold configuration.

11. A document folding apparatus according to claim 10 further comprising means for manual input of said length of the document.

12. A document folding apparatus according to claim 9 comprising a slotted disc attached to one of said rollers to measure said length.

13. A method of folding a document, comprising:

feeding the document along and between opposing guide tracks of a fold plate generally in the direction of, but not aligned with, the nip of a pair of output rollers, such that a predetermined length of the document overhangs an end of the fold plate;

pivoting the fold plate so that the end of the fold plate passes by the surface of one of the output rollers sufficiently closely to cause a section, having the predetermined length, of the overhanging document to fold over against the one output roller; and halting pivoting of the fold plate when the end of the fold plate is aligned with the nip of the pair of output rollers.

14. A method according to claim 13 wherein movement of the documents along said fold plate is halted while said fold plate is pivoted and re-started when said end is aligned with said nip of said output rollers.

15. A method according to claim 13 wherein an intended fold configuration for the document is manually entered.

16. A method according to claim 13 wherein said predetermined length is measured using a slotted disc attached to one of said rollers.

17. A method according to claim 16 wherein the slotted disc has slots spaced at intervals corresponding to between 0.2 mm and 2 mm paper travel.

18. For a document folding apparatus including a fold plate comprising a pair of guide tracks of which first ends are situated adjacent a pair of output rollers that define a nip for receiving a document from the fold plate, means for pivoting the fold plate about a pivot point spaced from the output rollers so as to move the first ends of the guide tracks between an aligned and an unaligned position with respect to the nip, and at least one pair of supply rollers for transporting the document along the fold plate between the guide tracks, a control system for controlling the apparatus, comprising:

means for facilitating input of a desired fold configuration of the document;

means for generating a signal to start movement of the rollers to transport the document along the fold plate;

means for generating a signal to pivot the fold plate about the pivot point to a position in which the end of the fold plate is unaligned with the nip;

means for sensing a leading edge of the document at a point along the fold plate and for determining when a predetermined length of the document will have passed the end of the fold plate;

means for generating a signal to stop the rollers and to pivot the fold plate from the unaligned position to a position in which the first ends are aligned with the nip so as to cause folding of the document; and means for generating a signal to start the rollers when the fold plate is in the aligned position so as to move the folded document to the nip and through the output rollers.

19. A document folding apparatus, comprising:

a first fold plate having one end adjacent a first pair of output rollers that have a nip for receiving a document from the first fold plate, the first fold plate comprising a pair of guide tracks and at least one pair of supply rollers for moving a document along and between the guide tracks of the first fold plate;

means for pivoting the first fold plate about a pivot point spaced from the first pair of output rollers, so as to move the end of the first fold plate between an aligned and an unaligned position with respect to the nip of the first pair of output rollers;

a second fold plate situated downstream of the first fold plate and of the first pair of output rollers, the second fold plate having one end adjacent a second pair of output rollers that have a nip for receiving a document from the second fold plate, the second fold plate comprising a pair of guide tracks and at least one pair of supply rollers for moving a document from the first pair of output rollers along and between the guide tracks of the second fold plate; and means for pivoting the second fold plate about a pivot point spaced from the second pair of output rollers, so as to move the end of the second fold plate between an aligned and an unaligned position with respect to the nip of the second pair of output rollers.

20. A document folding apparatus, comprising:

a fold plate comprising a pair of guide tracks and at least one pair of supply rollers for moving a document along and between the guide tracks of the fold plate;

a pair of output roller situated adjacent one end of the fold plate and defining a nip for receiving a document from the end of the fold plate; and means for pivoting the fold plate, about a point spaced from the output rollers, between an aligned and an unaligned position with respect to the nip, such that, during said pivoting, the end of the fold plate passes by the surface of one of the output rollers sufficiently closely to cause a portion of a document, being discharged from the end of the fold plate, to be folded over against the one output roller.

* * * * *